United States Patent [19]

Seppänen et al.

[11] 4,178,139

[45] Dec. 11, 1979

[54] CISTERN PUMPING PLANT

[75] Inventors: Rauno Seppänen, Kerava; Hannu Sarvanne; Sixten Jakobsson, both of Vantaa, all of Finland

[73] Assignee: Oy E. Sarlin AB, Helsinki, Finland

[21] Appl. No.: 876,830

[22] Filed: Feb. 10, 1978

[30] Foreign Application Priority Data

Feb. 14, 1977 [FI] Finland ..... 770478

[51] Int. Cl.[2] ..... E02D 29/12

[52] U.S. Cl. ..... 417/360; 52/20

[58] Field of Search ..... 417/360; 137/363, 342; 52/20, 21

[56] References Cited

U.S. PATENT DOCUMENTS

| | | | |
|---|---|---|---|
| 2,883,853 | 4/1959 | Forni | 52/21 |
| 3,018,925 | 1/1962 | Englesson | 417/360 UX |
| 3,112,760 | 12/1963 | Budd | 137/363 |
| 3,938,545 | 2/1976 | Nagy et al. | 417/360 X |
| 3,974,599 | 8/1976 | Grosh | 52/20 |

FOREIGN PATENT DOCUMENTS

| | | | |
|---|---|---|---|
| 44572 | 12/1938 | Netherlands | 52/20 |
| 457306 | 7/1968 | Switzerland | 52/21 |

*Primary Examiner*—Richard E. Gluck

*Attorney, Agent, or Firm*—Haseltine, Lake & Waters

[57] ABSTRACT

A cistern pumping plant having within a cistern at least one pump which for the purpose of maintenance and repairs is liftable along guides up onto a servicing platform in the cistern. The servicing platform and/or a part thereof is a plate hinged to the cistern and turnable to an opened position.

5 Claims, 1 Drawing Figure

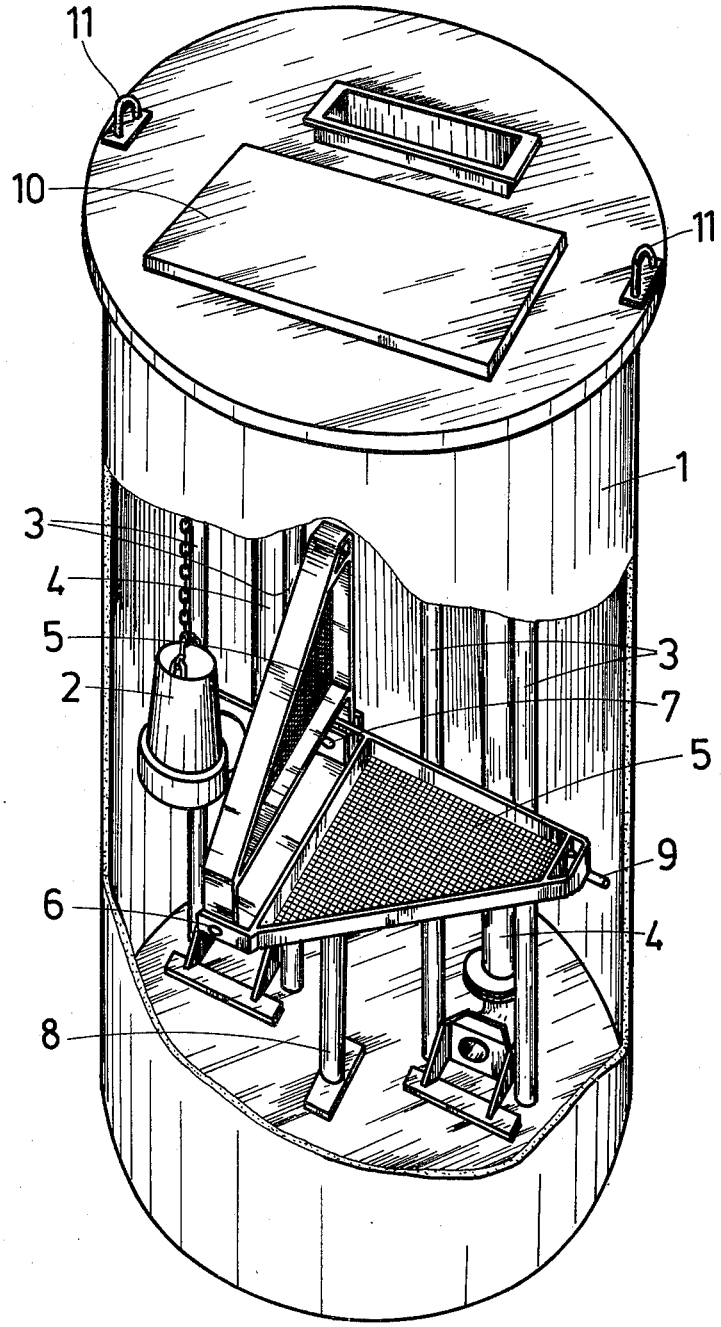
11
10
11
1
3
4
5
2
3
7
5
9
6
4
8

CISTERN PUMPING PLANT

BACKGROUND OF THE INVENTION

The present invention concerns a cistern pumping plant comprising within a cistern at least one pump which for purposes of maintenance and repairs is liftable along guides up onto a servicing platform in the cistern.

The drawback encumbering cistern pumping plants of this kind is the fact that the intermediate platform in the cistern is fixed. For servicing, the pumps have to be detached, through trap doors in the intermediate platform, from the guides and lifted up onto the intermediate platform. This is exceedingly awkward and time-consuming because the pump cannot be lifted onto the servicing platform directly with the block and tackle that is being used. In case there is an opening for the pumps and guides beside the servicing platform in the cistern, the diameter of the cistern has to be rather large. A large cistern diameter considerably increases the manufacturing cost of the cistern.

The object of the present invention is to eliminate the drawbacks mentioned and to provide, by a simple design solution, a cistern pumping plant which is easier to maintain, less extensive and of smaller structural bulk, and therefore also of lighter weight.

SUMMARY OF THE INVENTION

The cistern pumping plant of the present invention has a servicing platform and/or a part thereof which is a plate with attached hinges to the cistern and which can be turned to an opened position. Thus it becomes possible to lift the pump that has to be serviced or repaired, directly into a position above the servicing platform turned to its opened position, whereupon the servicing platform is turned to the horizontal position and the pump is lowered to rest thereupon.

A preferred embodiment of the invention is a cistern having two hinged servicing platforms located in one common plane. Thus it becomes possible for a person to stand on one of the two servicing platforms while the other has been turned into its opened position for the purpose of lifting the pump. At the same time, the servicing platform that has been turned into the opened position may serve as protective railing. As a rule, cistern pumping plants of this type have two pumps, and therefore both servicing platforms will be hinged so that the pumps can be lifted up in alternation.

Another embodiment of the invention has a surface area of the servicing platforms about one-half of the cross section area of the cistern. This is a simple design, where there remains space for pipes and guides on one side of the cistern.

A third embodiment of the invention has a servicing platform consisting of a metal grating. This has the advantage that the servicing platform is not slippery, and its cleaning is an easy task.

BRIEF DESCRIPTION OF THE DRAWINGS

The invention is described in the following with the aid of an example, with reference being made to the attached drawing, which presents a cistern pumping plant according to the invention, viewed in an oblique direction from above and partly sectioned.

DESCRIPTION OF THE PREFERRED EMBODIMENTS

The cistern pumping plant consists of the cistern 1, which nowadays is usually made of reinforced plastic. The cistern 1 contains two pumps 2, of which one only has been depicted. The pumps 2 move, in connection with their lifting and lowering, along the guides 3. When lowered, the pumps 2 are connected to the pipe system 4. The cistern pumping plant contains two hinged servicing platforms 5 located in one common plane. In the FIGURE, one of them is in the horizontal position and the other has been raised into vertical position for the lifting of the pump 2. Of the hinge pins 6,7 of the servicing platforms one, 6, has been affixed to the wall of the cistern 1 and the other, 7 to a vertical support 8, which has been mounted on the bottom of the cistern 1. Also attached to the wall of the cistern 1 are hooks 9, which give support to the servicing platforms 5 in the horizontal position.

It is possible from the servicing platform 5 of the cistern pumping plant to service and repair the valves and piping above the servicing platform, but the pumps 2 located below the servicing platform also require periodic maintenance and therefore they have to be lifted up onto the servicing platform 5 one at a time. For this reason the servicing platforms 5 have been so hinged that they can be raised from a horizontal into a vertical position, whereby the pump 2 that is to be lifted can be lifted above the intermediate platform 5 which is in the vertical position, whereupon the intermediate platform is lowered into the horizontal position and the pump 2 is lowered to rest thereupon. The intermediate platform 5 lifted into the vertical position serves as protective railing at the same time. The servicing platforms 5 have been made of metal grating, hence they are not slippery and their cleaning is easily accomplished, for instance with a water jet. If the pumps 2 are totally removed from the cistern pumping plant, their lifting out directly through the cover 10 is very easily accomplished, after the servicing platform has been turned into its opened position. If the servicing platform 5 is not needed in the cistern pumping plant, it can be easily dismounted by detaching the hinge pin 7, whereby the servicing platforms 5 come loose.

The reference numerals 11 indicate rings by which the cistern pumping plant as a whole can be suspended, for instance from the hook of a crane.

It is obvious to a person skilled in the art that different embodiments of the invention may vary within the scope of the claims following below. For instance, there may be only one servicing platform 5, or there may be more than two. As shown in the drawing, the servicing platforms are turned from horizontal to vertical, but it is also possible to arrange them to be turned downward, or on the other hand, one upon the other.

We claim:

1. A cistern pumping plant comprising at least one pump within a cistern having a vertical wall; a plurality of guides; a servicing platform, said guides located between said platform and the wall and extending from a lower portion of said cistern below said platform to an upper portion of said cistern above said platform, said pump being liftable for maintenance and repairs along said guides up onto said servicing platform inside said cistern; said servicing platform comprising a plate hinged to the cistern and being turnable from a horizontal position, whereby a pump that is in need of being serviced being liftable directly into position above the servicing platform that has been turned to its open position whereupon the servicing platform is turned to its horizontal position and the pump is lowered to rest thereupon.

2. A cistern pumping plant according to claim 1, characterized in that in the cistern there are two hinged servicing platforms located in one common plane.

3. A cistern pumping plant according to claim 2, characterized in that the area of the servicing platforms is about one-half of the cross sectional area of the cistern.

4. A cistern pumping plant according to claim 1, characterized in that the servicing platform consists of a metal grating.

5. A cistern pumping plant as defined in claim 1 wherein said cistern has two hinged servicing platforms located in one common plane; said servicing platforms having an area equal to substantially one-half of the cross-sectional area of the cistern; said servicing platforms being comprised of metal grating.

* * * * *